United States Patent [19]

Bryan, Jr.

[11] 4,204,664

[45] May 27, 1980

[54] WINCH MECHANISM FOR CRANE

[75] Inventor: John F. Bryan, Jr., Dallas, Tex.

[73] Assignee: Pyramid Manufacturing Company, Houston, Tex.

[21] Appl. No.: 857,605

[22] Filed: Dec. 5, 1977

Related U.S. Application Data

[63] Continuation-in-part of Ser. No. 721,775, Sep. 9, 1976, abandoned.

[51] Int. Cl.[2] ..... B66D 1/76

[52] U.S. Cl. ..... 254/175.7; 254/184; 212/49

[58] Field of Search ..... 254/175.5, 175.7, 186 R, 254/150 R, 183, 184; 212/49, 58 R, 28, 41, 48; 242/117

[56] References Cited

U.S. PATENT DOCUMENTS

| | | | |
|---|---|---|---|
| 1,245,186 | 11/1917 | Brothers | 212/49 |
| 1,440,600 | 1/1923 | Holley | 254/186 R |
| 2,998,094 | 8/1961 | Fisher | 254/186 R |
| 3,020,022 | 2/1962 | Turnquist | 254/175.7 |
| 3,467,360 | 9/1969 | Mizell | 254/175.7 |
| 3,966,170 | 6/1976 | McKenna | 254/175.7 |

FOREIGN PATENT DOCUMENTS

| | | | |
|---|---|---|---|
| 232426 | 3/1944 | Switzerland | 254/175.7 |

*Primary Examiner*—Kenneth W. Noland
*Attorney, Agent, or Firm*—Richards, Harris & Medlock

[57] ABSTRACT

A winch mechanism includes a first and a second drum each having multiple grooves therein. A frame supports the first drum spaced from the second drum with the axis of rotation of the first drum canted relative to the rotational axis of the second drum such that the grooves at the top of the first drum are substantially aligned with corresponding grooves at the top of the second drum and the grooves at the bottom of the first drum are substantially aligned with grooves adjacent to the corresponding grooves at the bottom of the second drum. A cable is alternately wrapped between the grooves of the first and second drums with at least one of the drums being driven to draw in and feed out the cable.

6 Claims, 23 Drawing Figures

WINCH MECHANISM FOR CRANE

REFERENCE TO RELATED APPLICATION

This application is a continuation-in-part of application Ser. No. 721,775, filed Sept. 9, 1976 now abandoned.

FIELD OF THE INVENTION

This invention relates to cranes of the type used in heavy construction operations, and more particularly to a winch mechanism used in cranes to draw in and let out the load line or the topping line.

THE PRIOR ART

Crane structures are used extensively throughout the construction industry for hoisting and moving materials and equipment used in the building process. Generally, the cranes are composed of a base structure rotatably mounted on either a stationary foundation or a mobile power unit. A boom is pivotally attached to the base structure, and a load hoisting cable, generally controlled from an operating station near or on the base structure, depends from the end of the boom for attaching loads thereto. A gantry structure is fixedly attached to the base, behind the boom pivot, and a topping line runs from the top of the gantry to the point of the boom. The boom is elevated and lowered by means of the topping line which lengthens and shortens.

Prior art cranes have generally used a rotational drum as the winch mechanism for drawing in and letting out the topping line and load line. In these cranes, the drum is merely rotated to wind in or let out cable, and cable is wound onto and fed from the drum as desired. In this arrangement, cable is wrapped over itself as it is drawn in and wound onto the drum. Thus, the cable experiences substantial wear as a result. Further, these systems require cable guides to prevent cross-winding of the cable onto the drum. Moreover, the torque required to turn the drum varies as the cable is wound onto the drum because the effective drum diameter continuously changes as cable is added to the drum.

SUMMARY OF THE INVENTION

The present invention discloses an improved load lifting crane structure which overcomes many of the deficiencies of prior art apparatus by utilizing a mast and upper tension member system affixed to the top surface of the boom. This system permits the use of hydraulic cylinder means for elevating the boom while subjecting the boom only to compressive loads and not to bending moments. This system also permits the adaptation of a counterweight to a crane in a novel manner whereby the counterweight is supported by a tension member which joins into the upper tension member system to achieve a uniquely effective load path.

In accordance with one embodiment of the invention, the crane structure comprises a base having a boom pivotally supported at one end from the base. The opposite end of the boom is adapted for receiving the load to be lifted by the unit. Hydraulic cylinder(s) are connected to the base and to an intermediate location on the boom such that when the cylinder(s) are retracted the boom is substantially horizontal and when the cylinders are extended the boom pivots to a position approaching the vertical. A mast is attached to the boom at a location on the upper surface of the boom and provides for a rearwardly disposed tension member or back-stay running from the top of the mast to the rear portion of the boom, and a forwardly disposed tension member or pendant line running from the top of the mast to the point of the boom.

In accordance with another embodiment of the invention the back-stay member can be made as an extendable spring and dampener that will serve to cushion dynamic overloads such as are incited by wave action in marine applications.

In accordance with yet another embodiment of the invention the mast is given a lateral dimension exceeding the width of the boom cross-section and the forwardly disposed upper tension members include at least two diagonal components running from one side of the upper end of the mast to the opposite side of the boom. The diagonal components are preferably clamped together at the point where they cross. This arrangement serves to support the end of the boom during operation in out of level conditions in such a manner that the boom is not subjected to twisting and side bending moments.

In accordance with yet another embodiment of the invention a counterweight is hingedly attached to the end of the boom supported from the base. When the counterweight is aligned with the boom, it may be selectively moved from an extended to a retracted position along a path substantially parallel to the longitudinal axis of the boom. In this embodiment of the invention, the fact that the counterweight is not fixedly attached to the boom but is hinged therefrom permits the counterweight to be angularly rotated relative to the boom during hoisting operations. In this way, the counterweight may be extended to work at a significantly greater radius than would be possible with a fixed boom-counterweight structure. Because the counterweight may be retracted relative to the boom, clearance problems caused by structures adjacent the work area of the crane are likewise overcome.

In this embodiment, the crane of the present invention is adapted with structure for maintaining the hingeable counterweight structure substantially horizontal as the boom is pivoted on the base. In this arrangement, the counterweight is hinged relative to the boom and is maintained horizontal regardless of the vertical angle of the boom while hoisting or performing similar operations. The hingeable counterweight structure, when maintained horizontal throughout the angular elevation range of the boom, eliminates ground clearance problems that would otherwise obtain in that the counterweight stays in substantially the same position relative to the ground and other surrounding structure as the boom elevates.

In accordance with another embodiment of the present invention, the counterweight comprises a longitudinal arm hingedly attached from the boom in the vertical plane of the boom. Attached to the end of the longitudinal arm remote from the boom is a weight unit wherein the weight of the counterweight unit is concentrated. This counterweight structure is chosen in order to provide the bulk of the weight of the counterweight with a maximum moment arm through which to act thereby increasing the effectiveness of the counterweight. In accordance with this embodiment of the invention, structure is also provided for hinging the arm relative to the boom structure to maintain the longitudinal axis of the arm substantially horizontal as the boom is rotated in a vertical plane.

In this embodiment of the invention, not only are the problems heretofore experienced with respect to ground clearance alleviated, but additionally the compensating moment provided by the counterweight is maintained at a maximum by retaining the maximum moment arm through which the concentrated weight unit acts as the boom elevates. This configuration is to be contrasted to prior art units where the counterweight rotates with the boom thereby reducing the effective moment arm through which the counterweight acts.

In this embodiment of the invention, the structure for maintaining the counterweight horizontal includes a mast extending substantially perpendicularly from the boom, a first sheave system attached to the top of the mast and a second sheave system attached to the base. A cable extends from the counterweight and is entrained about the first sheave system and the second sheave system and attached to the boom whereby pivoting of the boom varies the length of the section of the cable system between the counterweight and the first sheave system to maintain the counterweight horizontal as the boom is pivoted.

In accordance with another embodiment of the invention, the structure for maintaining the counterweight level during rotation of the boom further includes a third sheave system attached to the boom. In this embodiment of the invention, the cable system extends from the counterweight and is entrained about the first sheave system and multiply wrapped about the second and third sheave systems whereby pivoting of the boom varies the length of the section of the cable system between the counterweight and the first sheave system to compensate for pivoting of the mast with the boom to maintain the counterweight horizontal as the boom rotates.

In accordance with still another embodiment of the invention, a triangular structure has one corner rotatably attached to the underside of the boom with at least one sheave attached to a second corner thereof and a bearing surface on a third corner for bearing against the underside of the boom as the boom is pivoted upwardly. The sheave attached to the triangular structure is adapted to receive line from the second sheave system. This arrangement for maintaining the counterweight horizontal during rotation of the boom compensates for decreasing draw up of the cable system during high angles of rotation by the boom.

In accordance with still another embodiment of the invention, the structure for maintaining the counterweight horizontal during rotation of the boom comprises a measuring device for measuring the position of the counterweight relative to horizontal. A servo system is connected to the counterweight and is operative in response to the measuring device to hinge the counterweight relative to the boom in order to reposition the counterweight to horizontal as the boom pivots.

In accordance with still another embodiment of the invention, a winch is provided with a cable extending from the winch to the counterweight. The winch is operative in response to a device for measuring the angular position of the counterweight relative to horizontal such that the winch is energized to draw up and let out the cable in order to maintain the counterweight level as the boom rotates.

In accordance with still another embodiment of the present invention, a cable is provided extending along the boom to its load bearing end. The cable is adapted for supporting the load to be carried by the boom. A winch mechanism is supported by the base structure and is adapted for controlling the length of the cable to raise and lower the loads attached thereto. The hoist mechanism comprises two drums with multiple straight grooves about which the cable is alternately wrapped. The rotational axis of one drum is parallel to the axis of the second drum. The multiple wraps of the cable system about the drums generate sufficient traction to raise the loads attached thereto.

In accordance with still another embodiment of the present invention, the hoist mechanism for controlling the movement of the load bearing cable includes a first drum having multiple grooves therein and a second drum having multiple grooves therein. The axis of rotation of said first drum is canted relative to the axis of rotation of said second drum and the cable is alternately wrapped between the grooves of the first and second drums. At least one of the drums is driven to draw in or let out cable to raise or lower the load carried by the cable.

In another embodiment of the invention, the first and second drums are maintained in a side by side relation and the rotational axis of the first drum is canted relative to the rotational axis of the second drum such that the grooves at the top of the first drum are in alignment at the top with corresponding grooves in the second drum and grooves at the bottom of the first drum are in alignment at the bottom with grooves adjacent to corresponding grooves of the second drum. In this arrangement, the cable may be wrapped around the first and second drum consecutively through each of the grooves formed therein with a minimum of induced side loading or torsion being imparted to the cable. This is a result of the particular alignment of the grooves in the drums such that the cable follows a path in which successive grooves are aligned one with the other.

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
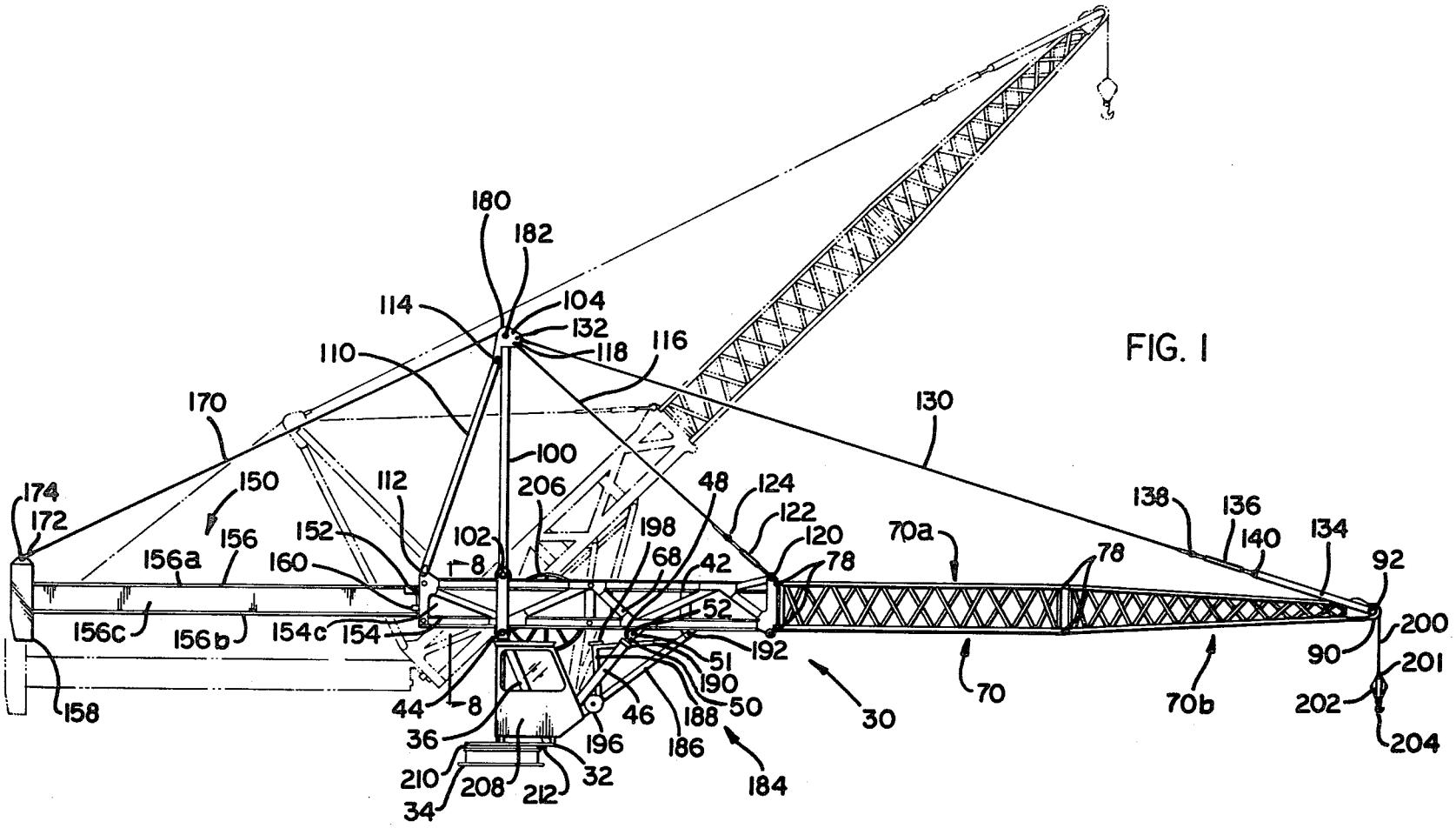
FIG. 1 is a side elevational view of an embodiment of the crane embodying the present invention.

FIG. 1 illustrates a side view of a crane 30 embodying the present invention. Crane 30 includes a base structure 32 rotatably secured to a foundation structure 34. Extending from base 32 is a superstructure 36, to which a boom 42 is attached. Superstructure 36 is rigidly attached to base 32 and boom 42 pivots at the upper end by axis shaft 44. Support member 40, in a preferred embodiment of the invention, is a hydraulic ram including a ram cylinder 46 and a ram piston 48 which is joined to a clevis 50. One end of hydraulic ram cylinder 46 is rotatably attached to base 32 while clevis 50 is rotatably pinned to a lug 51 extending from the underside of boom 42 by pin 52.

Joined at one end of boom 42 is a boom extension 70 consisting of elements 70*a* and 70*b*. The boom extension 70*a* is removably joined to main boom 42 by suitable fasteners 78 and boom extension 70*b* is joined to boom extension 70*a* by the same fasteners. The end of boom extension 70*b* remote from boom extension 70*a* is adapted with a sheave system 90. Sheave system 90 is rotatably secured to boom extension 70*b* about rotational axis shaft 92.

Extending upwardly from main boom 42 is mast 100 which is rotatably pinned to boom structure 42 along the top surface thereof by axis shaft 102. The end of mast 100 remote from boom 42 is adapted with a juncture plate 104. Removably secured between juncture plate 104 and the rearward end of boom 42 is mast support member 110. Mast support member 110 is joined between boom 42 and juncture plate 104 by suitable pins 112 and 114, respectively. A cable assembly 116 is fixedly attached between juncture plate 104 and the most forward end of boom 42 by pins 118 and 120, respectively. Intermediate of the points of connection between juncture plate 104 and boom structure 42 is a turn buckle 122 for appropriately adjusting the tension on cable 116.

Similarly, a cable assembly 130 extends from juncture plate 104 at the uppermost end of mast 100 and the most forward end of boom extension 70*b* in order to transmit loading from the boom through the mast and into the base structure. Cable assembly 130 is joined to juncture plate 104 and boom extension 70*b* by pin 132 and connecting strap 134, respectively. In a preferred embodiment of the invention, connecting strap 134 is joined to boom extension 70*b* at axis shaft 92. A tensioning mechanism 136 is connected by suitable fasteners 138 and 140 intermediate of cable 130 and connecting strap 134 to permit selective tensioning of cable 130.

A counterweight assembly 150 is hingedly attached at pin shaft 152 to an I beam section 154 which is slidable within the boom 42. Counterweight assembly 150 is composed of an I beam section 156 rigidly attached to a weighted end unit 158. I beam section 156 is adapted with guide ears 160 for aligning the counterweight I beam section 156 with I beam section 154.

I beam section 156 includes an upper cap 156*a*, a lower cap 156*b* and a web 156*c*. Similarly, I beam section 154 includes an upper cap 154*a* (not shown), a lower cap 154*b* (not shown) and a web 154*c*. A cable system 170 is joined to weight unit 158 by coupling member 172 and pin 174. Cable system 170 extends around a sheave system 180 (not shown) positioned adjacent to juncture plate 104 at the uppermost end of mast 100. Sheave system 180 has as its rotational axis shaft 182.

Cable system 170 extends around sheave system 180 and is connected to boom 42 through a triangular take-up structure 184 in a manner to be hereinafter described in detail. Triangular take-up structure 184 consists of a rigid structure including sides 186, 188 and 190. One end of side 186 is rotatably pinned by suitable pin 192 to boom 42. The opposite end of side 186 is adapted with a sheave system 196, to be hereinafter described in greater detail. A bearing pad 198 is fixedly attached at the juncture of sides 188 and 190 and is adapted for bearing against the lower side of boom 42 during operation of the unit as will hereinafter be described in greater detail.

Also illustrated in FIG. 1 and to be described hereinafter in further detail, is hoist cable 200 extending from the load bearing end of boom extension 70*b* and about sheave system 90. Attached to the end of hoist cable 200 by pin 201 is hoist block 202 adapted with hook 204.

Referring again to FIG. 1, a take-up reel 206 is attached for rotation from the boom 42. Fixedly attached to base 32 is a cab structure 208 from which the crane unit is operated.

Crane 30 is supported for rotation about a vertical axis from base structure 32 on foundation structure 34. In a preferred embodiment of the invention, foundation structure 34 is adapted with teeth 210 about the circumference thereof. Extending from base structure 32 is a rotatable pinion wheel 212 which mates with teeth 210 on foundation structure 34. By rotating pinion wheel 212, base structure 32 and thus crane 30, may be selectively rotated about a vertical axis, relative to foundation structure 34.

Figure 2:
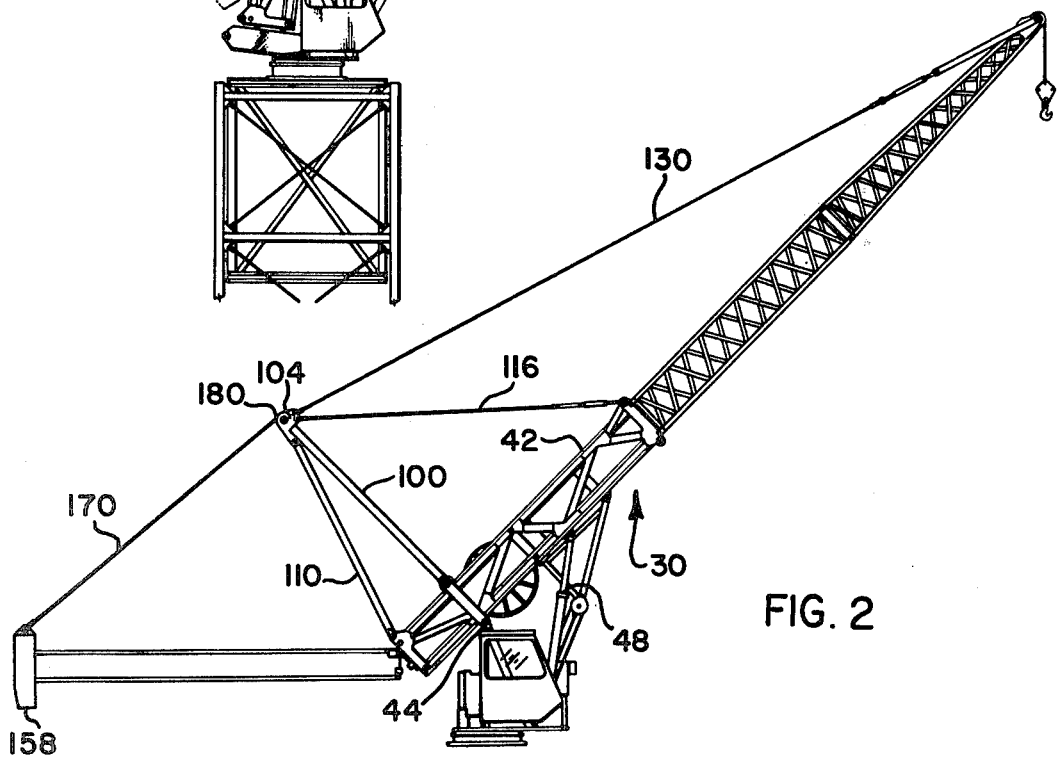
FIG. 2 is a side elevational view of the embodiment illustrated in FIG. 1 showing the boom rotated upwardly.

Referring to FIG. 2, crane 30 is shown with boom 42 pivoted upwardly about axis shaft 44. As is illustrated in FIG. 2, upward rotation of boom 42 is accomplished by extending ram piston 48 thereby causing rotation of the boom about axis shaft 44. As mast support strut 110 and support cables 116 and 130, each extending from juncture plate 104 to points along boom 42 are each fixedly attached to the boom, the relationship of mast 100 to boom 42 remains unchanged as boom 42 is rotated upwardly. Due to the leveling mechanism, to be hereinafter described in greater detail, the portion of counterweight cable system 170 between the weight unit 158 and the sheave system 180 is automatically shortened as boom 42 is raised. The arrangement for automatically taking up the counterweight cable system 170 is so designed as to maintain the longitudinal axis of counterweight assembly 150 horizontal throughout all rotational positions of the boom.

Figure 3:
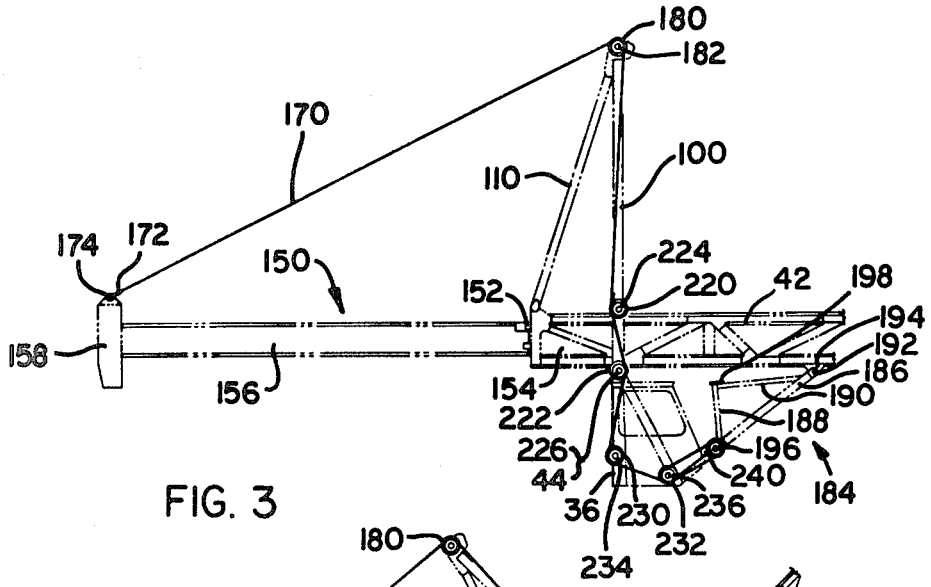
FIG. 3 illustrates one embodiment of the system for maintaining the counterweight in a horizontal configuration during rotation of the boom.
Figure 4:
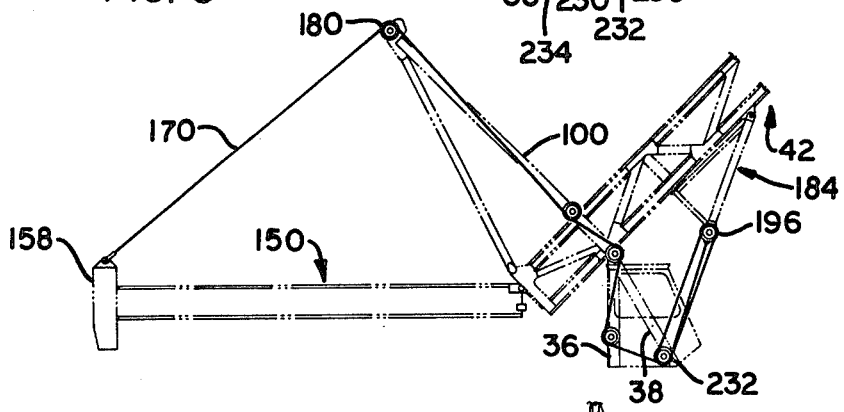
FIG. 4 shows the boom in an intermediate rotational stage with the counterweight maintained in a horizontal position by the leveling system.
Figure 5:
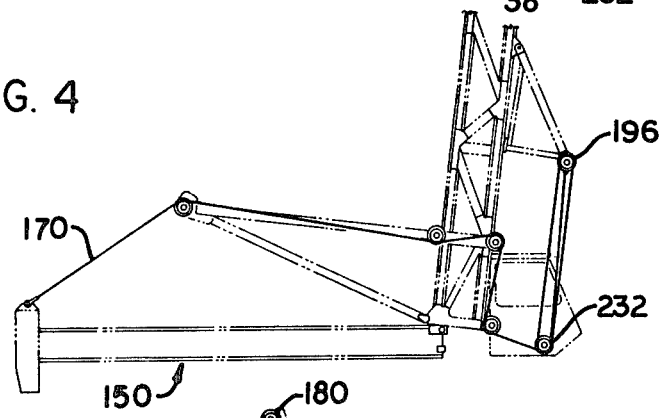
FIG. 5 shows the boom in its maximum up position with the counterweight maintained in a horizontal position by the leveling system.

One embodiment of the counterweight cable system 170 is illustrated in FIGS. 3, 4 and 5. Referring to FIG. 3, the superstructure 36 is shown supporting boom 42 at axis shaft 44. Mast 100 and mast support strut 110 are shown extending from boom structure 42 as hereinbefore described.

Counterweight assembly 150 is shown hingedly attached at pin 152 to I beam 154 slidably engaged within boom structure 42. Weight unit 158 attached to the end of counterweight I beam 156 is shown connected to leveling cable system 170 by coupling member 172 and pin 174.

Rotatably attached at axis shaft 182 is sheave system 180. Similar sheave systems 220 and 222 are rotatably positioned about axes 224 and 226, respectively, on boom 42, and sheave systems 230 and 232 are rotatably attached to superstructure 36 by axes pins 234 and 236, respectively. Triangular take-up structure 184, consisting of side members 186, 188 and 190, is joined at one end of side 186 by pin 192 to ear 194 extending from the lower portion of boom structure 42. The opposite end of side 186 is adapted with sheave system 196. The corner at which sides 188 and 190 of triangular take-up structure 184 are connected is adapted with bearing pad 198 as hereinabove described. The sheave systems 196 and 232 are adapted with multiple parallel sheaves having a common axis of rotation.

Cable system 170 is attached at one end to weight unit 158 of counterweight assembly 150 by coupling member 172 and pin 174. Cable system 170 extends from weight unit 158 and is entrained alternately around sheave systems 180, 220, 222, 230 and 196. Cable system 170 is multiply wrapped about sheave systems 232 and 196 and is thereafter fixedly attached adjacent sheave system 196 by coupling member 240. Referring to FIG. 3, it may be seen that the length of cable system 170 is such that the longitudinal axis of counterweight assembly 150 is in line with longitudinal axis of boom 42 when boom 42 is in the horizontal position.

FIG. 4 illustrates the boom in a rotated position and shows the resultant effect on cable system 170 and counterweight assembly 150. Referring to FIG. 4, it may be seen that the portion of cable system 170 between weighted end unit 158 and sheave system 180 at the upper end of mast 100 is shortened as a result of the movement of sheave system 196 with the rotation of boom 42. As boom 42 rotates upwardly in a horizontal plane, sheave system 196, attached to the boom 42 by way of triangular take-up structure 184 moves upwardly with boom 42 and away from sheave system 232 attached to base support member 38. As illustrated in FIGS. 3 and 4, cable system 170 is wrapped three times about sheave systems 196 and 232. As a result, line 170 is drawn three times the distance sheave system 196 is moved from sheave system 232. This take-up in cable system 170 in conjunction with the arrangement of the other sheave systems about which cable system 170 is entrained, hinges counterweight assembly 150 about axis pin 152 to maintain the counterweight horizontal throughout the rotation of the boom.

Referring to FIG. 5, the boom has been rotated to its uppermost rotational position moving sheave system 196 further from sheave system 232 and thereby effectively shortening cable system 170 to maintain the counterweight assembly 150 horizontal throughout the upper movement of the boom. In the rotational positions between that illustrated in FIG. 4 and that illustrated in FIG. 5, it may be seen that triangular take-up structure 184 has been rotated about its point of connection at pin 192 toward the lower side of the boom 42 such that bearing pad 198 contacts the lower surface of boom 42. In this way, sheave 196 is maintained a sufficient distance away from boom 42 and slightly further from sheave system 232 than in the configuration where the triangular take-up structure is absent. This arrangement results in the additional take-up of the length in cable system 170 necessary in the upper rotational stages of the boom in order to maintain the counterweight assembly 150 horizontal.

Figure 6:
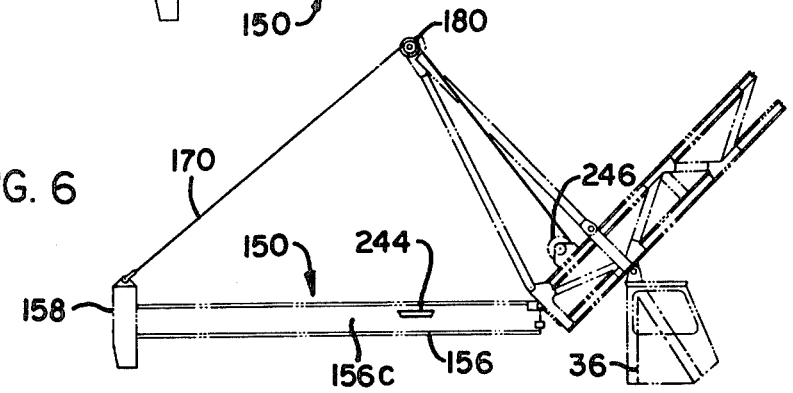
FIG. 6 illustrates an alternative embodiment for maintaining the counterweight level during rotation of the boom.

FIG. 6 illustrates an alternative embodiment of the present invention wherein the counterweight assembly is maintained in its level configuration by a leveling sensor 244 which energizes a winch unit 246 to draw in and let out cable system 170 to maintain the counterweight assembly 150 level during the movement of the boom. Referring to FIG. 6, winch unit 246 is adapted for receiving one end of cable system 170. In this embodiment, winch unit 246 is substituted for sheave systems 230 and 232 and triangular take-up structure 184. Leveling sensor 244 is attached to web 156c and I beam assembly 156 by suitable means. Leveling sensor 244 is of the type capable of sensing movement of counterweight assembly 150 and of generating a signal when the longitudinal axis of I beam section 156 moves out of line with the horizontal. Appropriate circuitry (not shown) is interconnected between sensor 244 and winch 246 for relaying the signal transmitted by sensor 244. Winch 246 is operative in response to the signal emitted by sensor 244 and is appropriately controlled to drawn in or let out cable system 170 whenever counterweight assembly 150 rotates from the horizontal to maintain the counterweight assembly level at all times.

Thus, in this embodiment, cable system 170 extends from the weight unit 158 around sheave system 180 and is attached to winch 246. As the boom is rotated in a horizontal plane, sensor 244 generates an appropriate electrical signal which in turn energizes winch 246. In this way, line 170 is drawn in and let out in accordance with the signal from sensor 244 to maintain the counterweight assembly level throughout movement of the boom structure. Therefore, in the embodiment illustrated in FIG. 6, the purely mechanical method illustrated in FIGS. 3–5 for maintaining the counterweight horizontal is replaced by an electrical servo system operating a winch unit to draw in and let out the counterweight cable system as necessary to maintain the counterweight horizontal.

Figures 7, 8, 9:
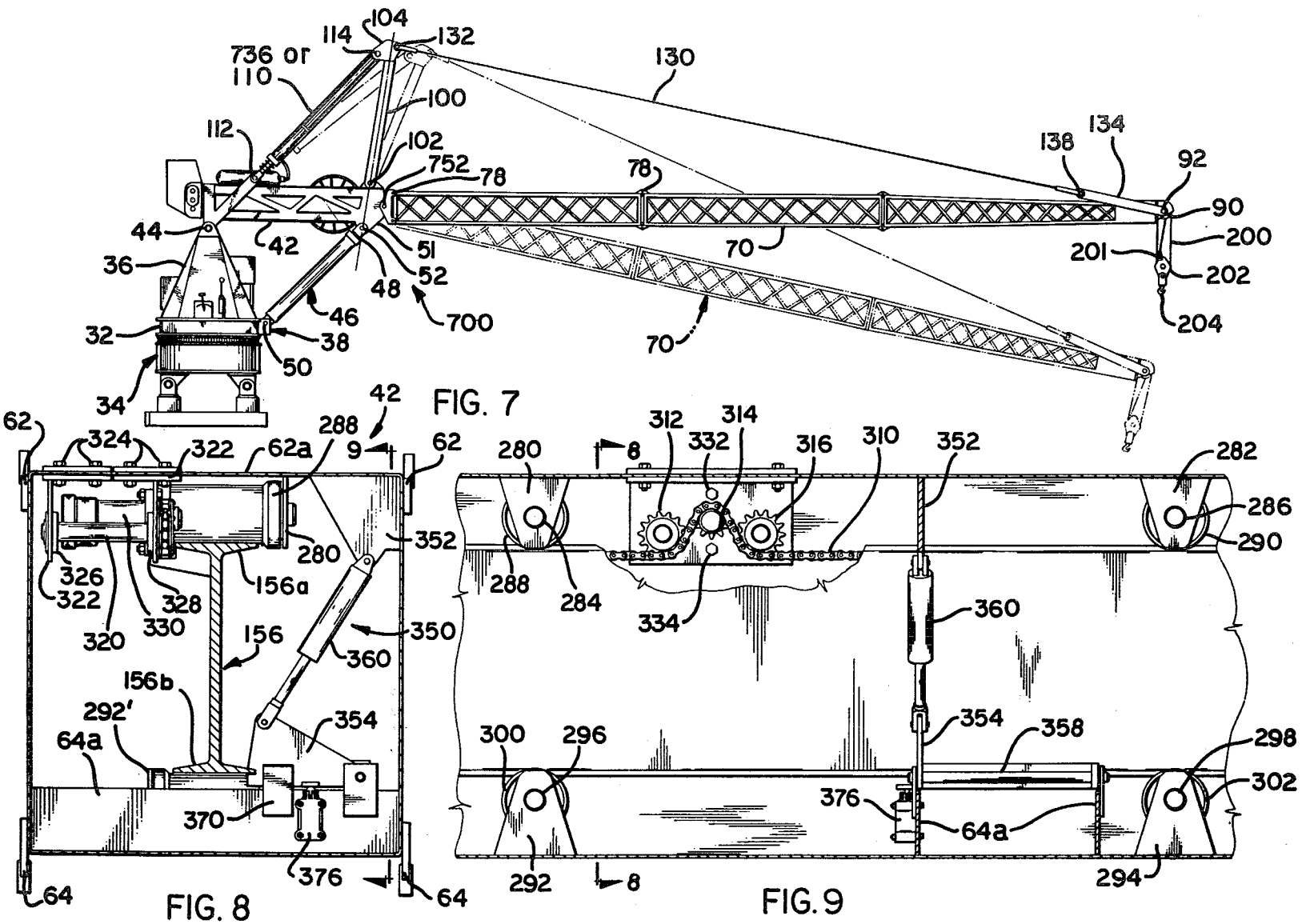
FIG. 7 is a side elevational view of a preferred embodiment of the crane of the present invention.
FIG. 8 is a sectional view taken along line 8—8 of FIG. 1.
FIG. 9 is a sectional view taken along line 9—9 of FIG. 8 showing the retraction mechanism for withdrawing the counterweight into the boom.

FIG. 7 illustrates a side view of a crane 700 constructed in accordance with one embodiment of the present invention. Crane 700 includes a base structure 32 secured to a foundation 34. A superstructure 36 is mounted on base structure 32 which rotates about a vertical axis during operation of the crane. A boom 42 is supported from superstructure 36, being pinned at its rearward end to the apex of superstructure 36 by axis shaft 44 and supported forwardly thereof by a hydraulic cylinder 46. Cylinder 46 is attached at clevis fitting 38 on the base 32 and ear 51 extending from boom 42 by axes pins 50 and 52, respectively.

A mast 100 is pivotally pinned to main boom structure 42 along the top surface thereof by axis shaft 102 and extends upwardly therefrom. The end of mast 100 remote from boom 42 is adapted with a juncture plate 104. A hydraulic cylinder 736 or optionally a mast support member 110 is connected between the main boom structure 42 by axis pin 112 and to juncture plate 104 by axis pin 114. While FIG. 7 illustrates single hydraulic cylinders 46 and 736, it will be understood that in the preferred embodiment of the invention, these elements are used in pairs with elements of each pair positioned on opposite sides of the main boom structure and operating in unison one with the other.

A boom extension 70 extends from boom 42 and is attached thereto by axis shaft 752. The end of boom extension 70 remote from main boom structure 42 is adapted with a sheave system 90 rotatably secured to boom extension 70 by rotational axis shaft 92. A strap 134 has one end supported to axis shaft 92 of boom extension 70 and the opposite end attached by way of coupling member 138 to a cable assembly 130 which supports the end of boom extension 70 remote from main boom structure 42 from juncture plate 104 and mast 100 by way of coupling 132.

As has been discussed previously with respect to other embodiments of the invention, main boom structure 42 can be constructed to receive a counterbalance unit which may be telescoped outwardly to counterbalance the weight supported from the working end of boom extension 70.

As will be appreciated by examination of FIG. 7, the structure is designed to provide direct load paths through mast 100 and member 110 through boom 42 into superstructure 36 and hydraulic cylinder 46. In this way, bending stresses which would normally be introduced into boom 42 are minimized with the load being substantially carried directly into superstructure 36.

Hydraulic cylinder 46 operates to pivot boom 42 about axis pin 44 by extension and retraction in the conventional manner. Additionally, hydraulic cylinder 736 serves to permit pivoting of boom extension 70 about axis pin 752 when a shock load greater than the rated capacity of the crane is imposed on the boom. The hydraulic circuit and the operation of this shock overload protection system is described hereinafter in FIG. 19.

FIGS. 8 and 9 illustrate the mechanism for retracting and extending the counterweight into and out of the boom. FIG. 8 is a sectional view taken along lines 8–8 of FIGS. 1 and 9. FIG. 9 is a sectional view taken along lines 9—9 of FIG. 8. Referring to FIG. 8, the boom structure 42 is adapted with longitudinal support members 62 and 64. Interconnected between longitudinal support members 62 and 64 are transverse support members 62*a* and 64*a*. As is shown in FIG. 9, lugs 280, 280′ (not shown), 282 and 282′ (not shown) extend from transverse support members 62*a*. Extending through lugs 280 and 280′ and through 282 and 282′ are axes pins 284 and 286, respectively. Rollers 288 and 290 are suspended on axes pins 284 and 286, respectively, and between lugs 280 and 280′ and 282 and 282′, respectively.

Similarly, lugs 292 (not shown) and 292′ and 294 and 294′ (not shown) extend upwardly from lower transverse support structure 64*a* to support axes pins 296 and 298 and rollers 300 and 302, respectively.

Rollers 288, 290, 300 and 302 have a constant diameter cylindrical midsection with flanges at either end for accepting upper and lower caps 156*a* and 156*a* of counterweight I beam 156. Counterweight I beam 156 rides on rollers 300 and 302 and below rollers 288 and 290 and is guided within boom structure 42 by these rollers during the retraction and extension of the counterweight assembly.

Referring to FIGS. 8 and 9, and specifically to FIG. 9, chain 310 is connected at each end to counterweight assembly 150 and is entrained about sprocket wheels 312, 314 and 316. Referring to FIG. 8, it may be seen that sprocket wheel 312 is rotatable about shaft 320 which is supported by a support bracket 322 extending downwardly from transverse frame member 62*a* and attached thereto by suitable fastening means such as bolts 324. Shaft 320 is rotatably received within support bracket 322 by bearing assemblies 326 and 328, respectively. Although not shown, sprocket wheel 316 is similarly supported within support brackets 322. Sprocket wheel 314 is driven by a suitable motor 330 which is suitably attached to support bracket 322, such as by bolts 332 and 334.

Thus, by energizing motor 330 to rotate sprocket wheel 314, chain 310 may be driven forward or aft. By rotating sprocket wheel 314 counterclockwise (as viewed in FIG. 9), counterweight assembly 150 is moved to its extended position out of the boom. Similarly, by rotating sprocket wheel 314 clockwise, as viewed in FIG. 9, chain 310 is made to draw counterweight assembly 150 into the boom structure.

Also illustrated in FIGS. 8 and 9 is a locking mechanism 350 for locking the counterweight assembly either in the fully extended or fully retracted position and for preventing the operation of the crane assembly whenever the counterweight assembly is intermediate of these positions. Locking assembly 350 includes a bracket 352 rigidly attached to the boom structure and a lock plate 354 rotatably hinged to transverse frame structure 64*a*. A hydraulic cylinder 360 is pinned between bracket 352 and plate 354, respectively. The lock plate 354 is so positioned as to mate with notches within the lower cap 156*b* of counterweight I beam 156 when the counterweight assembly is either in the fully extended or fully retracted position. By actuating the hydraulic cylinder 360, the lock plate 354 is made to engage the notch within the lower cap 156*b* of the counterweight I beam 156 thereby restraining the counterweight assembly from movement axially along the boom structure. A support plate 370 extends upwardly and is fixedly attached to transverse frame elements 64*a*. Support plate 370 provides an additional restraint to lock plate 354 and provides more rigidity thereto when in the locked position.

When lock plate 354 is in the locked position, that is, sufficiently rotated such as to engage the notch within the counterweight I beam 156, it makes contact with electrical switch 376 closing the circuitry through the crane power source and permitting operation of the unit. Otherwise, the power source to the crane system is always open, thereby preventing operation of the unit whenever the counterweight system is not in the locked position.

Referring to FIG. 9, the shaft 358 on which lock plate 354 hinges is seen to be supported at both ends by transverse frame members 64*a*.

While only four roller supports are illustrated in FIG. 9, it will be understood that any number of upper and lower roller supports may be spaced along boom structure 42 as is necessary to accommodate the movement of counterweight assembly 150 into and out of the boom structure.

Thus, the present invention discloses a crane system wherein the counterweight is pivotally hinged from a section fixedly secured to the boom. The counterweight is automatically hinged as the boom is rotated upwardly in a vertical plane such that the longitudinal axis of the counterweight remains horizontal throughout the movement of the boom. Because the counterweight structure is maintained level throughout the angular rotation of the boom, ground clearance problems are eliminated in that the counterweight maintains substantially the same position relative to the ground and other surrounding structures as the boom rotates.

Not only are the problems with respect to ground clearance of an extended counterweight attached to the boom thus alleviated, but additionally the effectiveness of the compensating moment provided by the counterweight is maintained at a maximum by retaining the maximum moment arm through which the weight of the counterweight assembly acts. This configuration is to be contrasted to prior art units where the counterweight rotates with the boom as the boom rotates upwardly thereby effectively reducing the moment arm of the counterweight. Additionally, the present invention discloses structure for permitting the retraction of the counterweight assembly into the boom for adapting the unit for use in tightly confined areas and for preparing the unit for relocation.

Further, the manner in which the counterweight moment is carried to the base structure as well as the manner in which the moment produced by the load attached to the boom is directed into the base is significant. These loads are substantially supported through cable system 170 and cable assembly 130. Further, the load bearing paths represented by cable system 170 and cable assembly 130 are not interrupted by the hinging of counterweight assembly 150 in that cable system 170 provides a continuous load path from weighted unit 158 around the uppermost part of mast 100. While the tension loads on the mast from the counterweight and the boom tend to counterbalance each other, the vertical load applied through cable system 170 and cable assembly 130 into mast 100 are directed into the base structure therebelow. By so directing the loads introduced by the counterweight assembly and the load carried by the boom, the loading is more directly applied to the base structure.

Figure 10:
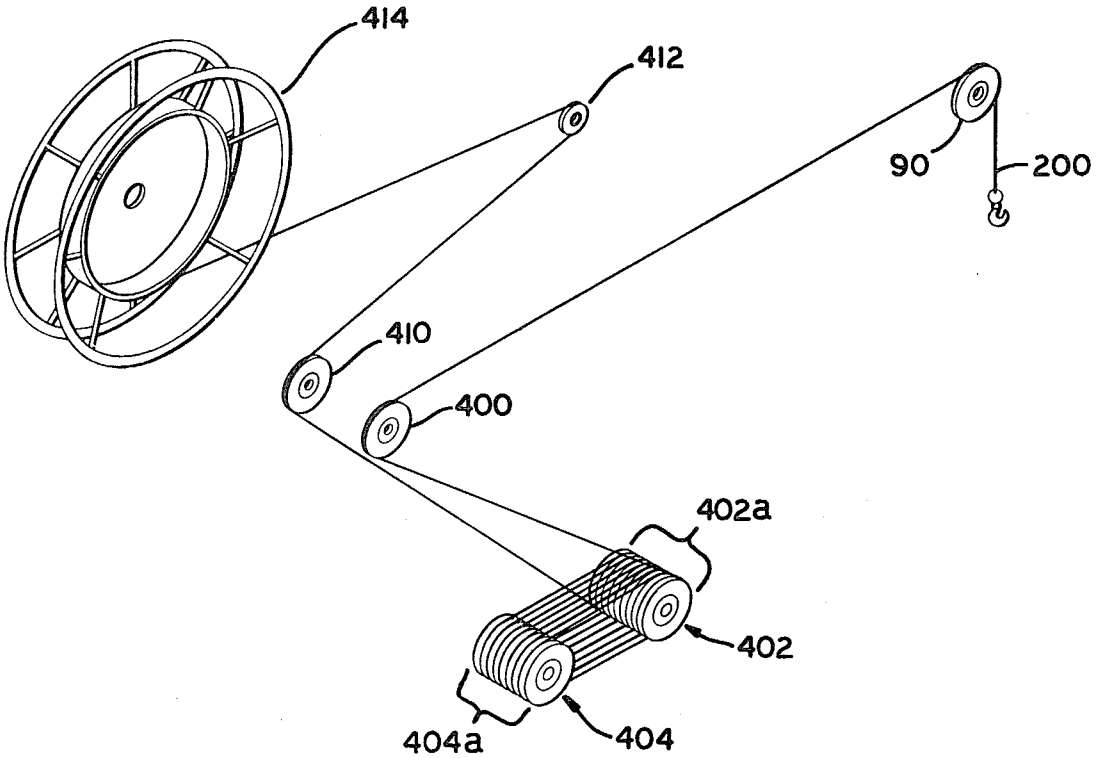
FIG. 10 is a schematic view of the hoist winch mechanism of the present invention.

FIG. 10 illustrates in a perspective schematic view the winch mechanism of the present invention. In accordance with the present invention, hoist cable 200 is entrained about sheaves 90 and 400 and multiply wrapped about drums 402 and 404. Drums 402 and 404 each have a plurality of grooves 402*a* and 404*a*, respectively. The rotational axis of drum 402 is appropriately spaced from and parallel to that of drum 404. Cable 200 is multiply and alternately wrapped between drums 402 and 404 such that the cable makes a single 180 degree wrap around any groove 402*a* or 404*a*. Cable 200 emerges from the drums 402 and 404 and passes around sheaves 410 and 412 and thereafter extends to take-up reel 414. Take-up reel 414 has an appropriate motor attached thereto (not shown) for applying a continuous nominal tensioning load, for example 50 to 60 pounds, to cable 200. Drums 402 and 404 are suitably attached for rotation on the base structure 32 of the crane assembly. Sheaves 90, 400, 410 and 412 and take-up reel 414 are each appropriately suspended for rotation from boom structure 42. Either or both drums 402 and 404 may be driven to provide the cable tension required for lifting loads. If both drums 402 and 404 are driven in the same direction of rotation the cable 200 will be wrapped around them in the manner illustrated. If the drums 402 and 404 are driven in opposite directions of rotation the cable 200 will be wrapped around the drums 402 and 404 in a figure eight fashion. If only one of the drums 402 or 404 is driven the cable 200 may be wrapped around the drums in either 180 degree or figure eight fashion.

Figure 11:
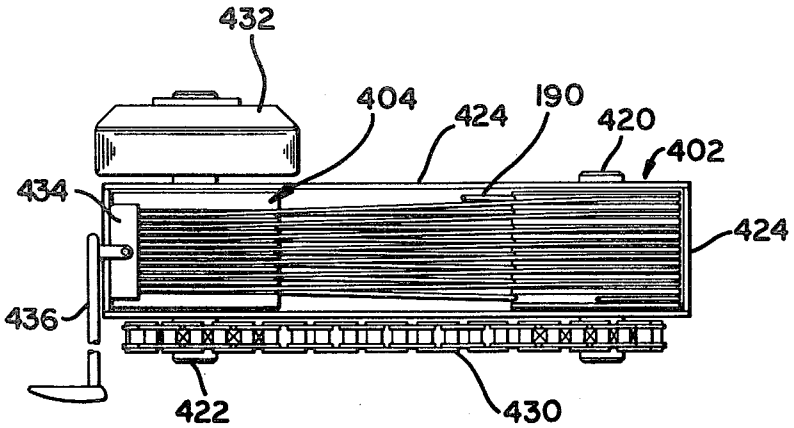
FIG. 11 is a top view of a portion of the hoist winch mechanism of FIG. 10 showing the winch mechanism of the present invention.
Figure 12:
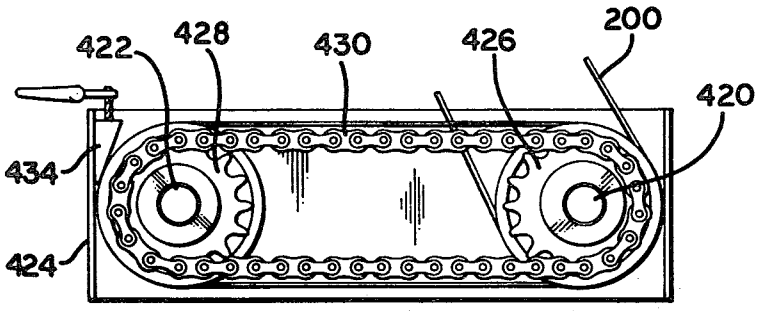
FIG. 12 is a side view of the portion of the winch mechanism shown in FIG. 11.

FIG. 11 illustrates a top view of opposed drums 402 and 404. As is best seen in FIG. 11, drum 402 is rotatable on shaft 420 and drum 404 is rotatable on shaft 422. The drums are maintained with their axes of rotation in a spaced parallel relationship by support housing 424 which encircles the two drums and supports the ends of shafts 420 and 422. Referring to FIGS. 11 and 12, sprocket wheel 426 is mounted for rotation with shaft 420 and sprocket wheel 428 is mounted for rotation with shaft 422. Sprocket wheels 426 and 428 are mounted on shafts 420 and 422 outside of support housing 424. Sprocket wheels 426 and 428 are coupled for rotation by endless chain 430. As may be seen in FIG. 11, an appropriate motor 432 engages shaft 422 opposite the end on which sprocket wheel 428 is mounted. Motor 432 may be powered by any suitable means. In preferred embodiments of the invention, the motor is either electrically or hydraulically powered. Thus, by rotating shaft 422, both drums 402 and 404 may be selectively rotated either in the forward or reversed direction.

Wedge 434 is slidably positioned adjacent drum 404 and may be selectively engaged or disengaged by handle 436 between drum 404 and support housing 424. As cable 200 is wrapped such that the cable is let out by the counterclockwise rotation of drum 404, as seen in FIG. 12, wedge 434 provides a fail-safe locking function by preventing the extension of cable 200 when the wedge is engaged between drum 404 and support housing 424.

Figure 13:
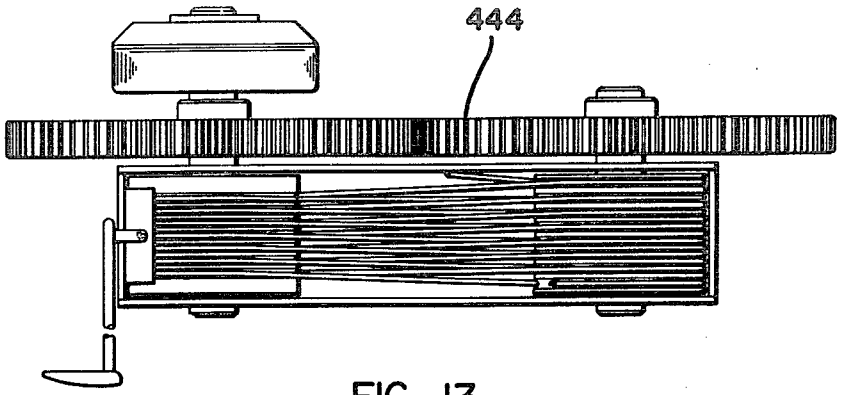
FIG. 13 is a top view of an alternative embodiment of a portion of the winch unit used in the present invention.
Figure 14:
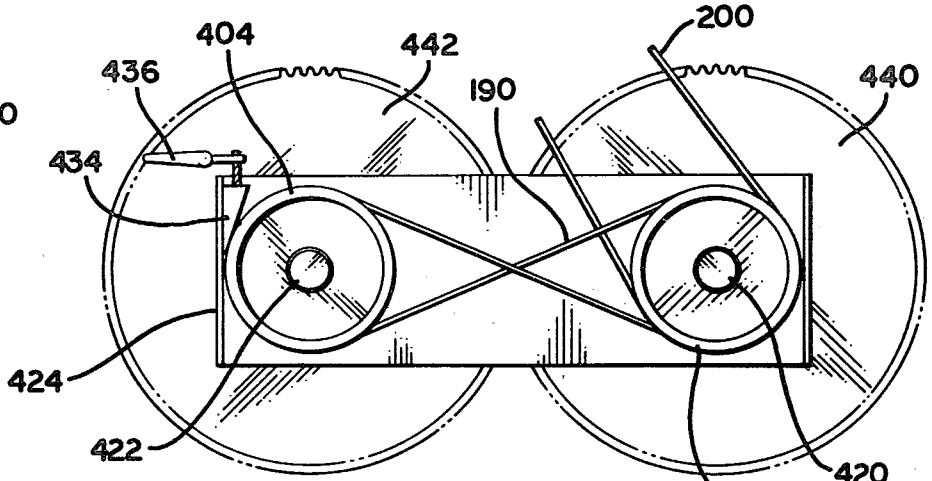
FIG. 14 is a side view of the portion of the winch mechanism illustrated in FIG. 13.

FIGS. 13 and 14 illustrate an alternative embodiment of the winch mechanism illustrated in FIGS. 11 and 12. In this embodiment, cable 200 is entrained around the successive grooves of drum 402 end drum 404 in a "figure eight" wrap design. Additionally, shafts 420 and 422 of drums 402 and 404, respectively, are adapted with gears 440 and 442 which are engaged with each other.

Thus, by multiply wrapping cable 200 about the drums 402 and 404, and by applying a nominal take-up load on the end of cable 200, sufficient gripping strength may be induced between the cable and the drums to draw in and extend cable 200 under its maximum load without experiencing any slippage of the cable relative to the assemblies. By using the figure eight wrap illustrated in FIG. 14, the gripping force between cable 200 and drums 402 and 404 is increased substantially so that fewer wraps may be employed.

The advantages in using the arrangement illustrated in FIGS. 10 through 14 are numerous. Initially, it will be appreciated that cable 200 is not at any time wrapped over itself while under a load as in prior art hoist drums. Thus, the substantial wear experienced in prior art devices by overlaying cable on the drum is eliminated. Further, the need for attempting to prevent cross-winding of the cable onto the drum is eliminated as there is no possibility of the cable being wound on itself.

Additionally, in the prior art systems where the take-up of the load bearing cable is on a single drum, the effective diameter of the drum would naturally vary as the cable was wound onto the drum. In the present invention, the drum diameter is constant and thus the torque necessary to turn the drums will remain constant throughout the operation of the unit. Likewise, in that the torque necessary to turn the drums will remain constant it will be directly related to the load on the cable. Thus, where the spool is actuated by a hydraulic powered system, a measure of the hydraulic line pressure will be a direct indication of the working tension on the cable. The cable load value is of substantial importance both in regard to the capabilities of the crane as well as in determining what the weight is of the load being hoisted. Thus, the present hoisting mechanism provides a ready means for generating a reading of the load being carried by the cable as well as for eliminating problems heretofore experienced with respect to wear on the cable and the torque required to draw in the cable.

Figure 15:
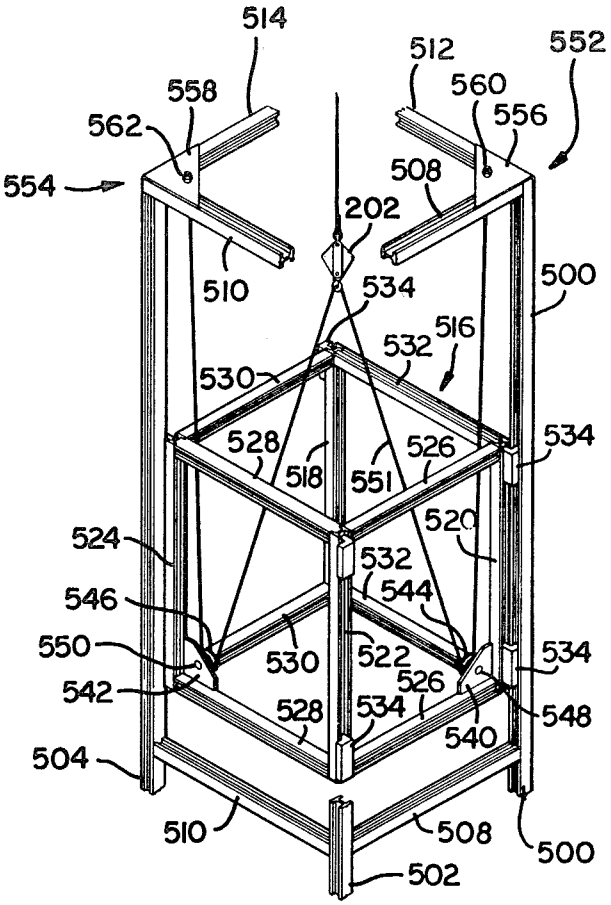
FIG. 15 illustrates the arrangement of the present invention through which the crane may be self-hoisted.

FIG. 15 illustrates a structure through which the crane system may be self-hoisted to a desired working height. The structure includes a main frame including legs 500, 502, 504 and 506 (not shown) which are supported by transverse struts 508, 510, 512 and 514. Slidably engaged within the main frame is a cage structure 516 including longitudinal legs 518, 520, 522 and 524 and transverse struts 526, 528, 530 and 532. The slidable cage structure 516 is adapted at each end of its eight corners with a guide bracket 534 which mates with a groove in the legs of the main frame to permit the cage structure 516 to slide longitudinally within the main frame. Cage structure 516 is adapted with corner brackets 540 and 542 at opposed lower corners. Sheaves 544 and 546 are attached for rotation about a horizontal axis through corner brackets 540 and 542, respectively, about axes pins 548 and 550, respectively.

A cable 551 is attached at its ends to the uppermost diagonally opposed corners 552 and 554 of the main frame through corner plates 556 and 558 by suitable fasteners 560 and 562, respectively. Cable 551 is entrained about sheaves 544 and 546 and adapted for attachment to hoist block 202 extending from the crane assembly. The crane structure is mounted on slidable cage structure 516. It may be readily recognized that by applying an upward force at the midpoint of cable 551, cage structure 516, and thus the crane assembly itself, is pulled upwardly relative to the main frame.

Figure 16:
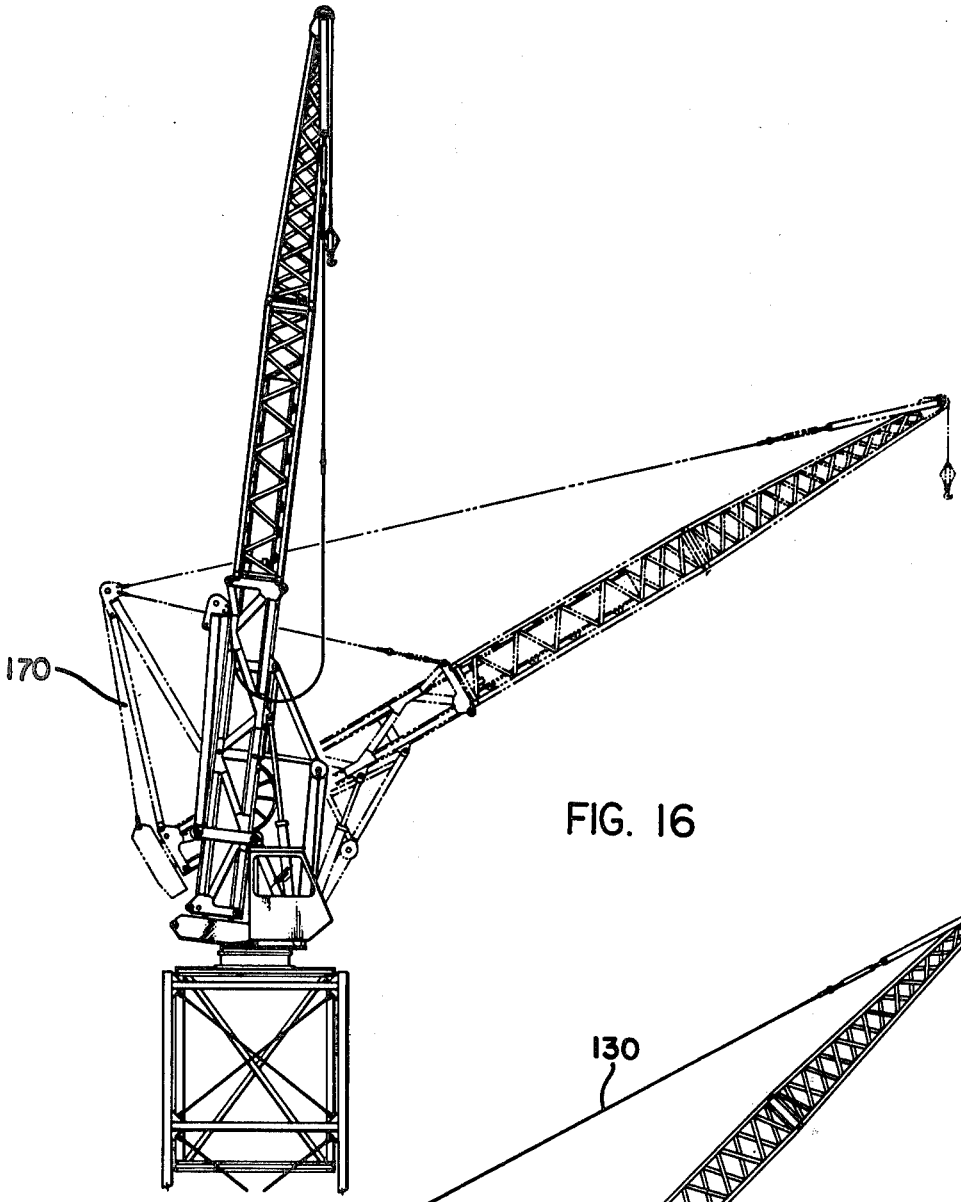
FIG. 16 illustrates the crane mounted for hoisting on the structure shown in FIG. 15.

FIG. 16 illustrates the crane moving upwardly within the main frame on cage structure 516. The crane has its boom in the most raised position, the slidable counterweight in its retracted position with the mast folded against the boom in order to clear the main frame in which the crane is elevated. It may also be seen that when the crane is raised to the top of the main frame structure, additional surrounding frame structure may be assembled. Thereafter, the cable arrangement earlier described with respect to FIG. 15 may be employed to pull the crane to higher levels as the main frame structure is extended. Thus, the crane may build its own tower and hoist itself to the top without any assistance from auxiliary equipment.

When the crane is being moved or is in operation near an adjacent interfering structure, the counterweight of the present invention may be retracted into the boom as shown. With the counterweight retracted, the boom may be rotated as when the counterweight is extended except without the benefit of the counterbalancing moment produced by the counterweight when in the extended position. The geometry of the counterweight leveling system is so arranged that the crane may be rotated to its maximum upward position without putting cable system 170 in tension. Tension in cable system 170 is unnecessary as the leveling system is non-functional when the counterbalance weight is in the retracted position. Alternatively, cable system 170 may be detached from the counterweight assembly when the counterweight assembly is in the retracted position.

Figure 17:
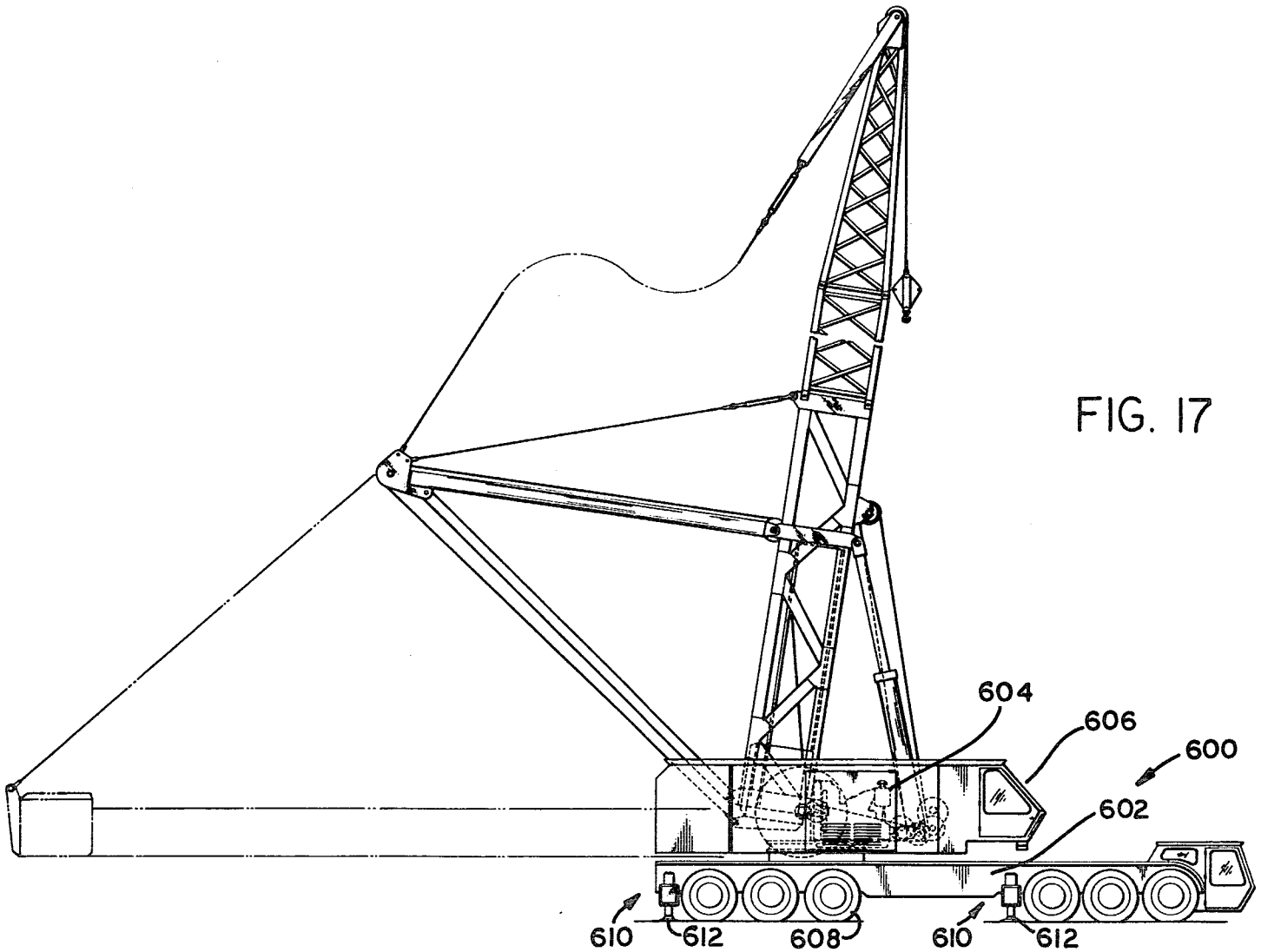
FIGS. 17 and 20 illustrate the crane of the present invention mounted on a self-powered motorized vehicle.
Figure 20:
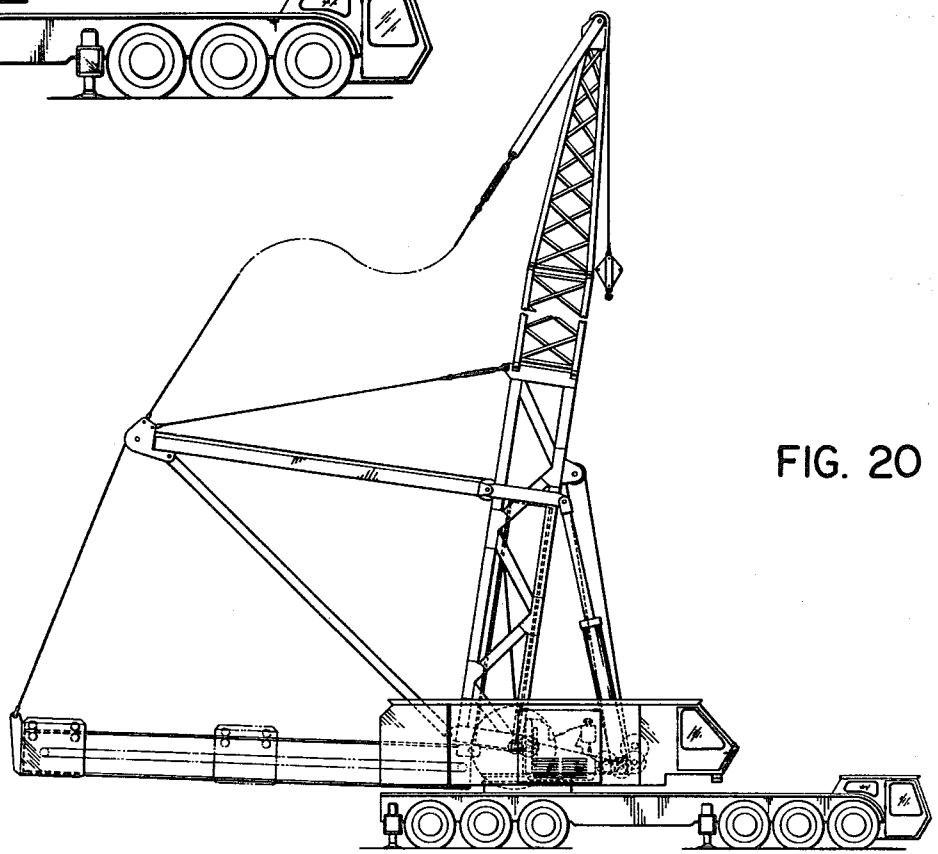

FIGS. 17 and 20 illustrate the crane of the present invention mounted on a self-powered motorized base vehicle 600. In this embodiment of the invention, the structure of the crane is similar to that described previously with respect to FIGS. 1–9. The base structure 32 is mounted onto a frame 602 of motorized vehicle 600, and the crane structure is adapted for rotation about vertical axis is well as pivoting about a horizontal axis as in the previous embodiments.

The motorized vehicle 600 is adapted with a prime mover 604 and a cab 606 supported by frame 602. The vehicle is movable on wheels 608. The vehicle may be stabilized by use of outriggers 610 positioned relative to the frame structure 602 for concentrating the load on foot pads 612 during operation of the crane.

Figure 18:
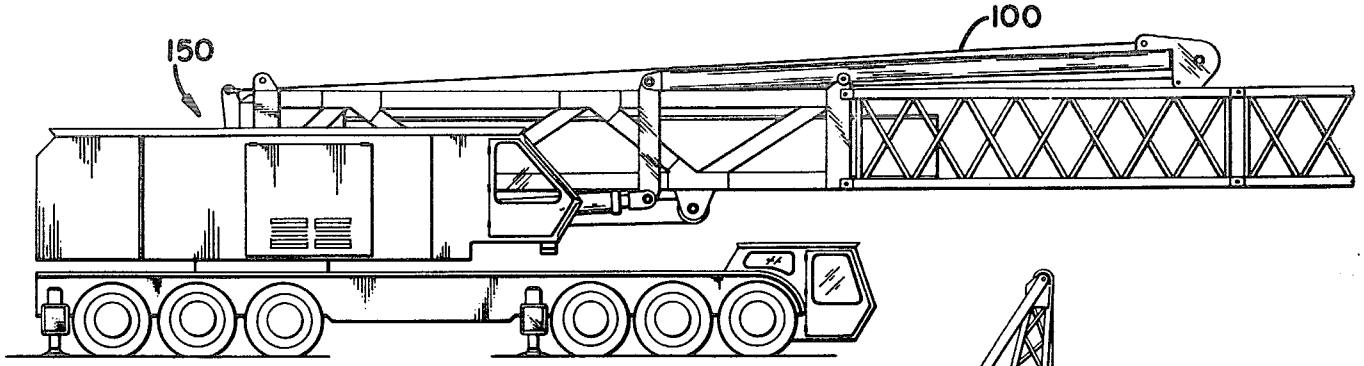
FIG. 18 illustrates the crane prepared to be moved on the motorized vehicle of FIG. 17.

FIG. 18 illustrates the embodiment disclosed in FIG. 17 wherein the crane has been positioned on vehicle 600 for movement from one location to another. As is illustrated in FIG. 18, boom structure 42 is pivoted to its most downward position, and mast 100 is likewise folded adjacent the boom structure. Additionally, counterweight assembly 150 is in its most retracted position within the boom structure.

Figure 19:
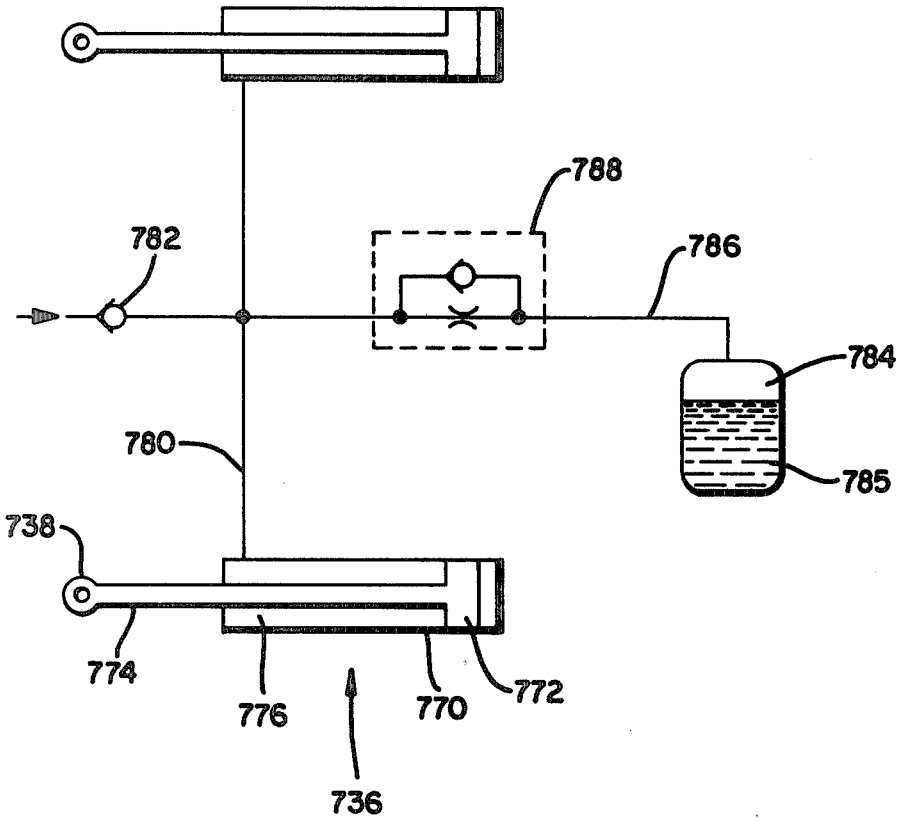
FIG. 19 illustrates the hydraulic circuit for a shock overload protection means used on the crane of the present invention.

FIG. 19 illustrates the hydraulic circuit for the shock overload protection means shown in FIG. 7. Hydraulic cylinder 736 includes a cylinder 770 and a piston 772. Piston shaft 774 extends out of the hydraulic cylinder and is attached as hereinabove indicated to boom 42 by axis pin 112. The chamber 776 formed by cylinder 770 and piston 772 within hydraulic cylinder 736 is loaded with fluid under pressure and resists the extension of hydraulic cylinder 736 and therefore the loading applied to the working end of boom extension 70. The volume of hydraulic fluid contained within cylinder 736 is sufficient to maintain boom extension 70 in line with boom 42 whenever the load applied to the working end of boom extension 70 is within the rated load capacity of the crane. Cylinder 770 is also fitted with a low pressure fluid maintenance line through which fluid is automatically replenished during the operation as is necessary due to leakage. A one way check valve 782 permits the flow of fluid into cylinder 736, blocking the outflow of pressurized fluid.

An accumulator 784 communicates by way of tubing 786 to chamber 776 of cylinder 736. Accumulator 784 acts to restrain and halt the downward movement of boom section 70 when a load greater than the rated load is applied to the boom section during operation. Accumulator 784 is precharged with a gaseous medium 785, to a pressure in excess of the pressure required to support cylinder 772 in reaction to a rated load on the end of boom section 70. A directional flow control 788 in line 786 between accumulator 784 and cylinder 736 permits fluid to freely enter the accumulator whenever larger compressive loading exists within the hydraulic cylinder as a result of loading on boom 70 greater than the rated loading. As may be seen in FIGS. 7 and 19, when the rated load limit is exceeded, the force exerted on hydraulic cylinder 736 overcomes the normal pressure maintained in the accumulator 784 thereby causing piston 772 to force hydraulic fluid from chamber 776 and into accumulator 784. As fluid is moved out of hydraulic cylinder 736 and into accumulator 784, the downward movement of boom section 70 is gradually halted as the pressure within the cylinder-accumulator system becomes sufficient to counterbalance the load carried by the boom extension. The directional flow control valve 788 restricts the return flow of fluid from the accumulator 784 dampening rebound action after the shock overload on boom 70 is cushioned.

A prime example of the advantage of the structure incorporated in the crane of FIGS. 7 and 19 is illustrated by the crane's operation to lift a load from a ship. In this mode of operation, the crane is normally fixed to a stationary platform and the load is lifted on hook 204 from the ship. The hook is drawn in to lift the load approaching in weight the load limit for the crane, from the ship's deck. When wave action causes the ship to simultaneously descend in the water, a resulting dynamic load is applied to the crane increasing the effective load on the crane's structure as much as two to four times to actual weight of the cargo being lifted. While there is some resiliency in the cable and other structure supporting the main boom structure and boom extension, this dynamic loading is in effect fully and immediately applied to the crane's structure and would normally exceed the structural limits of the crane. However, in the present invention, this dynamic loading is cushioned by the extension of hydraulic cylinder 736 and the resulting movement of boom extension 70 downwardly. Subsequent to the cushioning of the dynamic loading, the boom extension 70 is automatically repositioned relative to the main boom structure by the retraction of cylinder 736.

Therefore, the embodiment illustrated in FIGS. 7 and 19 provides a system which prevents impact loading which would otherwise be suffered by the structure of the crane without the movement permitted by hydraulic cylinder 736 and accumulator 784. In the present structure, dynamic loading above the rated capacity of the crane is accommodated by the movement permitted by hydraulic cylinder 736 and accumulator 784 without exceeding the structural limits of the crane.

Figure 21:
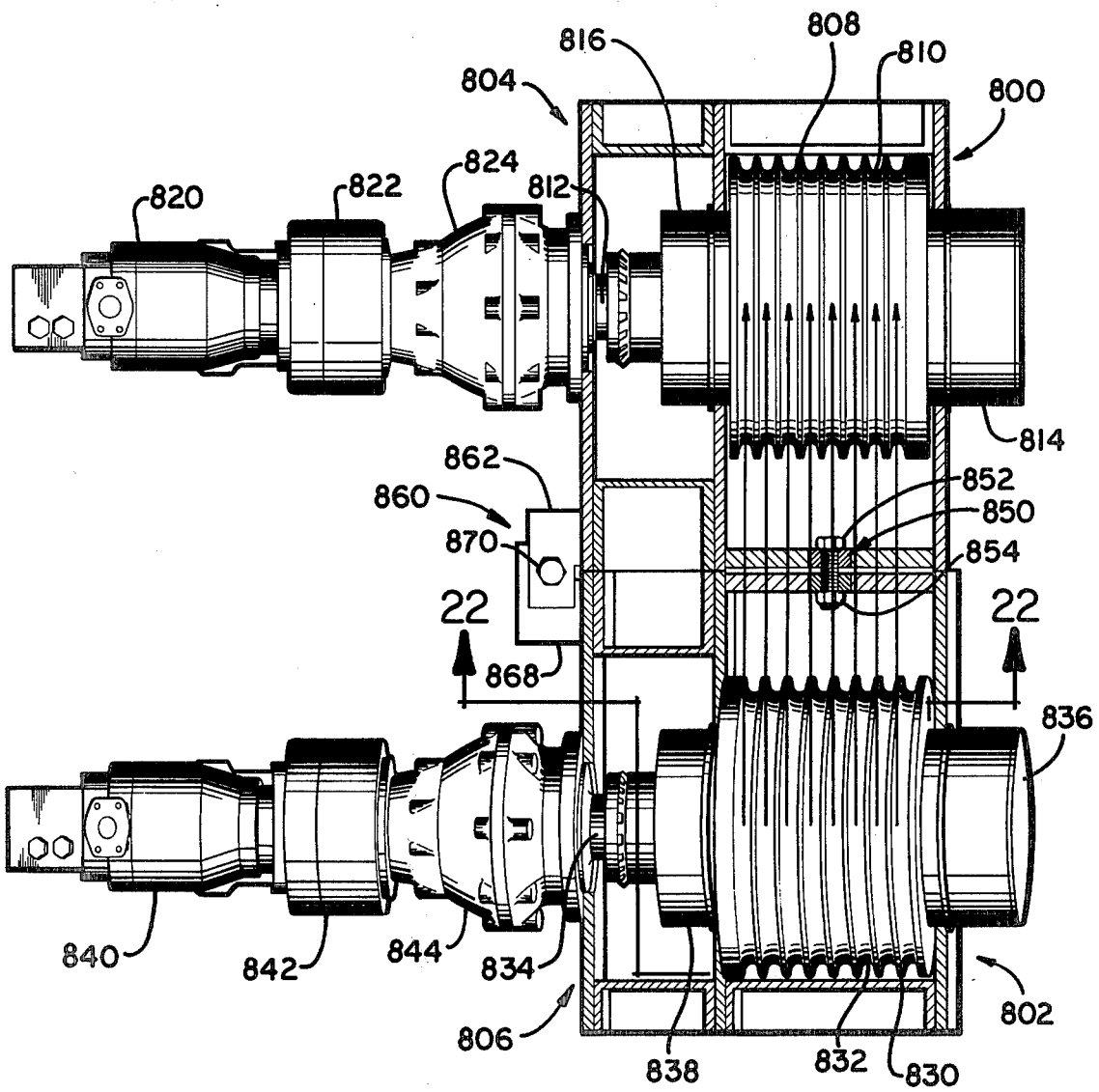
FIG. 21 illustrates an alternative embodiment of the winch mechanism illustrated in FIGS. 10 through 14.

FIG. 21 illustrates an alternative embodiment of the winch mechanism illustrated in FIGS. 10 through 14. The arrangement of FIG. 21 includes drum assemblies 800 and 802 mounted in housings 804 and 806, respectively. Drum assembly 800 includes a drum 808 having a plurality of parallel grooves 810 formed therein. Drum 808 is supported for rotation on a shaft 812 by bearings (not shown) received in bearing carriers 814 and 816 on opposite sides of drum 808. Bearing carriers 814 and 816 are supported in housing 804 thereby supporting drum 808. Shaft 812 is driven by hydraulic motor 820 through a spring loaded, hydraulic pressure released brake 822 and planetary gears (not shown) housed in planetary gear box 824. Planetary gear box 824 is attached to the side wall of support housing 804 by any suitable means.

Drum assembly 802 similarly includes a drum 830 formed with a plurality of parallel grooves 832 and supported for rotation on a shaft 834 by bearings (not shown) housed in bearing carriers 836 and 838 on opposite sides of drum 830. Bearing carriers 836 and 838 are supported in housing 806.

Shaft 834 is driven by hydraulic motor 840 through a spring loaded hydraulic pressure released brake 842 and planetary gears (not shown) housed in planetary gear box 844. Gear box 844 is attached to the side wall of support housing 806 by any suitable means.

Figure 22:
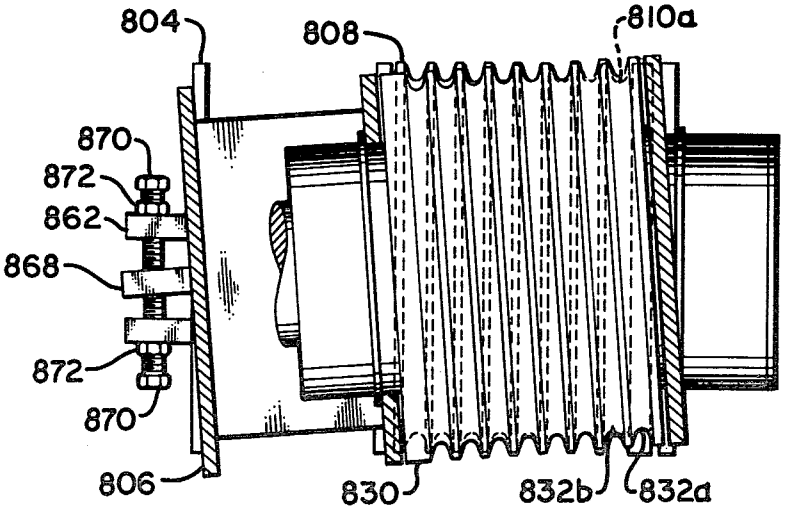
FIG. 22 is a partial section view of the winch mechanism taken along line 22—22 of FIG. 21 showing only the drums and their relative alignment.

As is illustrated in both FIGS. 21 and 22, the axis of rotation of drum 808 is canted or out of parallel alignment with that of drum 830. This relationship is achieved by the rotation of support housing 804 relative to housing 806 about pivot assembly 850. Assembly 850 includes a bolt 852 which serves as a pivot pin and a nut 854 which serves to clamp the support housings 804 and 806 together.

An adjustment assembly 860 is attached to the side walls of support assemblies 804 and 806 for adjustment of the canted angle between the rotational axes of drums 808 and 830. Adjustment assembly 860 includes an arm 868 extending from housing 806 and arms 862 similarly attached to support housing 804. Arms 862 are formed with threaded holes which receive set screws 870 and nuts 872. The angular relationship of housings 804 and 806 is controlled by the engagement of screws 870 against arm 868. This, in turn, permits the angular adjustment of the rotational axis of drum 808 relative to that of drum 830.

As is best illustrated in FIG. 22, by canting drum 808 relative to drum 830, the grooves therein may be aligned such that the cable wrapped thereon experiences little or no side loading heretofore introduced into the cable because of the relationship between the grooved drums. Where the axes of rotation of the drums are parallel, the cable is wound around the first groove of one of the drums to the first groove of the second drum. In returning the cable from the first groove of the second drum to the second groove of the first drum, the cable must be angled out of the plane of the first groove of the second drum to engage the second groove of the first drum. On each successive wrap from the second drum to the first drum, the cable must again be angled to engage the successive groove on the first drum. As a result, side loading as well as torsional forces, are induced into the cable. In addition to the stresses resulting from such loading, this configuration causes the cable to twist. In turn, where the load cable is used with a block in multiple parts, as in FIG. 23, the cable parts between the end of the boom and the block will twist and render the winch unusable.

As is illustrated in FIG. 22, in the present invention cable wound onto the first groove **832*a* of drum 830 leaves drum 830 at the rearwad portion of the drum where the groove 832*a* is substantially in line with groove 810*a* of drum 808. The cable leaves groove 810*a* at the forward portion of drum 808 where the groove 810*a* is in line with groove 832*b* of drum 830. Thus, as the cable is wound between drums 808 and 830**, there is little, if any, side loading introduced into the cable because of the substantial alignment of the grooves between the sheaves.

The angle $\phi$ between the rotational axes of drums 808 and 810 required to accomplish this alignment will naturally vary with the diameter and groove spacing of the drums involved. The cable is a wire rope made up of strands which are twisted tightly together. Each strand in turn is made up of a number of individual wires which are twisted tightly together. The number of strands, the number of individual wires per strand, the direction of twist of the strands and the wires as well as other factors, affect the flexibility of the cable and the degree to which it tends to untwist as it stretches under load.

The adjustment assembly 860 further permits the adjustment of the angular relationship between the drums to be fine tuned until twisting in the cable is reduced to a minimum. This adjustment permits compensation for the characteristics of cables of different types and construction.

Thus, it may be found that to minimize the twist in the cable will in some cases require substantially exact alignment of the drum grooves as shown in FIG. 22. In other cases, a somewhat over adjustment or under adjustment may be required. In any event, pivot assembly 850 and adjustment assembly 860 will permit the adjustment of drum 830 relative to drum 808 necessary to minimize cable wear and twisting.

Figure 23:
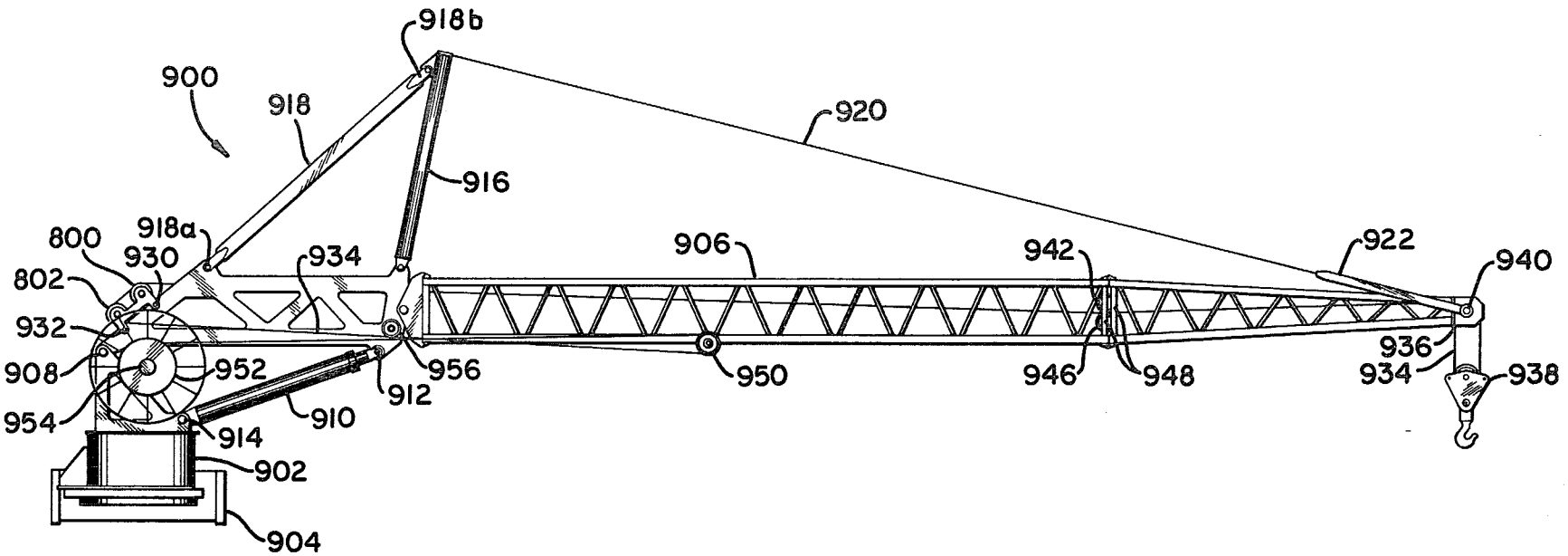
FIG. 23 illustrates the winch mechanism shown in FIG. 21 mounted on a crane.

FIG. 23 illustrates drum assemblies 800 and 802 mounted on a crane 900. Crane 900 includes a base 902 pivotable on a foundation 904. Boom structure 906 is mounted on base 902 at pivot point 908 and through rotation cylinder 910 mounted to boom 906 at pin 912 and base 902 at pin 914. Crane 900 further includes a mast 916 and mast support structure 918 which connects the upper end of mast 916 to boom 906. Mast support structure 918 is attached to boom 906 by a fitting 918*a* and to the upper end of mast 916 by a similar fitting 918*b*. Support cables 920 are connected between the upper end of mast 916 and the load bearing end of boom 906 by attachment 922.

Drum assemblies 800 and 802 are mounted on the rearward end of boom 906 by bolts 930 and 932. A cable 934 has one end attached to the load carrying end of boom 906 at point 936 and is directed through block 938, around a sheave (not shown) rotatable about an axis shaft 940 and through the lattice structure of boom 906 to drum assemblies 800 and 802. Cable 934 is guided through the lattice structure of boom 906 by idler sheaves 942 and 946 supported for rotation from boom support members 948. Cable 934 is then wound successively between multigrooved drums 808 and 830 as shown in FIGS. 21 and 22, then around idler sheave 950 and back to take-up drum 952 which is attached to base 902 for rotation about an axis 954. Cable 934 is guided from drum assembly 800 to idler sheave 950 by an idler roller 956 attached to boom 906 intermediate of the drum assemblies and idler sheave 950.

Cable 934 is carried around idler sheave 950 and then back to be stored on take-up drum 952. By locating idler sheave 950 at a distance somewhat removed from take-up drum 952, the fleet angle of the cable coming onto the take-up drum is substantially reduced permitting uniform winding of the cable onto the take-up drum along the full width of the drum surface.

While the winch mechanisms illustrated in FIGS. 10–14 and the alternative embodiment illustrated in FIGS. 21–23, are described as used on a crane, it will be understood that the winch mechanisms have application in any and every apparatus where a cable, bearing a load, is drawn in or let out.

Thus, the present invention discloses a crane operable on either a fixed or movable support structure. The crane includes a base having a boom pivotally supported at one of its ends from the base. The opposite end of the boom is adapted for receiving a load thereon. A mast is attached to the upper surface of the boom and an upper tension member system substantially relieving the boom structure of all bending and twisting loads so that it works only under compressive loads. In another embodiment a counterweight assembly is hingedly attached to the end of the boom supported from the base. This arrangement permits the counterweight to be angularly rotated separate from the boom during pivoting of the boom in a vertical plane. In this embodiment of the invention, the crame is adapted with structure for maintaining the extended counterweight structure substantially level as the boom is pivoted on the base.

In one embodiment of the invention, the structure for maintaining the counterweight assembly level during rotation of the boom structure is a cable system extending from the counterweight to the boom structure whereby the rotation of the boom draws the cable system such that the counterweight is maintained in a level position. Alternatively, a leveling sensor is attached to the boom and controls a cable take-up mechanism which draws in and extends the cable system attached to the counterweight in order to maintain the counterweight in a level configuration during operation of the boom.

In still another embodiment of the invention, the counterweight assembly is retractable and extendable into and out of the boom structure. Structure is provided for moving the counterweight assembly axially with respect to the boom structure and for providing a locking mechanism which prevents the operation of the crane when the counterweight assembly is intermediate of its most extended or retracted position.

In accordance with still another embodiment of the invention, the crane of the present invention is adapted with a cable system extending from the weighted end of the counterweight assembly over a mast structure positioned substantially over the base of the unit and a cable system extending from the load bearing end of the boom structure to the mast structure for more effectively introducing loads and moments into the base structure from both the counterweight assembly and the loads being lifted by the crane.

Further, the present invention includes a more efficient and controllable hoisting system used by the crane to perform its lifting function. The system of the present invention is one which permits continuous and accurate take-up of the hoisting cable while minimizing wear and damage to the cable heretofore experienced in prior systems. The line pull and speed are not affected by changing drum diameter as is the case with conventional drum hoists. The hoist mechanism of the present invention also substantially reduces or eliminates torsional and side loading normally induced in the cable by prior art traction winch units. Further, the present invention discloses a method through which the crane may construct its own structure and thereafter self-hoist itself to the top thereof.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. In a crane having a boom with a first end adapted for securing a load thereto and a second end pivotally attached to a base for supporting the boom therefrom, a winch mechanism comprising:

a first drum having multiple grooves therein, a second drum having multiple grooves therein, a first frame for rotatably supporting said first drum for rotation about the axis thereof, a second frame for rotatably supporting said second drum for rotation about the axis thereof, means for pivotally attaching the first frame to the second frame for canting the first drum relative to the second drum with the axes of rotation of the first and second drums being maintained in parallel planes, adjustment structure attached between the first and second frames for adjusting the cant of the first drum relative to the second drum, a cable alternately wrapped between the grooves of said first and second drums, one end of said cable extending along the boom to the first end of said boom, and means for driving at least one of said drums to draw in or let out said cable.

2. The winch mechanism of claim 1 wherein said means for pivotally attaching comprises:

pivot pin means connected between the first and second frame for pivotally securing the frames together.

3. The winch mechanism of claim 1 wherein said adjustment structure comprises:

a first arm extending from said first frame, a second arm extending from said second frame in an adjacent spaced apart relationship with said first arm, and set screw means operating between said arms for adjusting the distance between said arms to pivot said first frame about said pivot pin means to orient the first drum in a selected cant position relative to the second drum.

4. A friction drive winch comprising:

a first drum having multiple circumferential grooves therein, a second drum having multiple circumferential grooves therein, frame means for supporting said first drum spaced from said second drum such that the axis of rotation of said first drum is canted relative to the rotational axis of said second drum, a twisted cable alternately wrapped between the grooves of said first and second drums, for being placed under a tension load and being operable to slightly untwist when loaded, means for driving at least one of said drums to draw in or let out said cable, and adjustment means associated with said frame means for adjusting the cant of said first drum relative to said second drum, and said first drum being adjusted to a selected cant position for minimizing the untwist of said cable when placed under a tension load and drawn in or let out, said frame means and said adjustment means comprising;

a first frame for rotatably supporting said first drum for rotation about the axis thereof, a second frame adjacent the first frame for rotatably supporting the second drum for rotation about the axis thereof, means for pivotally attaching the first frame to the second frame for canting the first drum relative to the second drum with the axis of rotation of the first and second drums being maintained in parallel planes, and adjustment structure attached to the first and second frames for adjusting the cant of the first drum relative to the second drum.

5. A friction drive winch comprising:

a first drum having multiple circumferential grooves therein, a second drum having multiple circumferential grooves therein, frame means for supporting said first drum spaced from said second drum such that the axis of rotation of said first drum is canted relative to the rotational axis of said second drum, a twisted cable alternately wrapped between the grooves of said first and second drums, for being placed under a tension load and being operable to slightly untwist when loaded, means for driving at least one of said drums to draw in or let out said cable, and adjustment means associated with said frame means for adjusting the cant of said first drum relative to said second drum, and said first drum being adjusted to a selected cant position for minimizing the untwist of said cable when placed under a tension load and drawn in or let out, said frame means and adjustment means comprising:

a first frame for rotatably supporting said first drum for rotation about the axis thereof, a second frame for rotatably supporting the second drum for rotation about the axis thereof, pivot pin means and attachment structure for pivotally attaching the first frame to the second frame for canting the first drum relative to the second drum with the axes of rotation of the first and second drums being maintained in parallel planes, a first arm extending from the first frame, a second arm extending from the second frame in an adjacent spaced apart relationship with said first arm, and set screw means operating between said arms for adjusting the distance between said arms to pivot said first frame about said pivot pin means to orient the first drum in a selected cant position relative to the second drum.

6. In a crane having a boom with a first end adapted for securing a load thereto and a second end pivotally attached to a base for supporting the boom therefrom, a winch mechanism comprising:

the first drum having multiple grooves therein, a second drum having multiple grooves therein, a first frame for rotatably supporting said first drum for rotation about the axis thereof, a second frame for rotatably supporting said second drum for rotation about the axis thereof, pivot pin means and attachment means for pivotally attaching the first frame to the second frame for canting the first drum relative to the second drum with the axes of rotation of the first and second drums being maintained in parallel planes, a first arm extending from said first frame, a second arm extending from said second frame in an adjacent spaced apart relationship with said first arm, set screw means operating between said arms for adjusting the distance between said arms to pivot said first frame about said pivot pin means to orient the first drum in a selected cant position relative to the second drum, a twisted cable alternately wrapped between the grooves of said first and second drums, one end of said cable extending along said boom said first end of said boom for being placed under a tension load and being operable to slightly untwist when loaded, means for driving at least one of said drums to draw in or let out said cable, and said first drum being oriented to a selected cant position by adjusting said set screw means for minimzing the untwist of said cable when placed under the tension load and drawn in or let out.

* * * * *

UNITED STATES PATENT AND TRADEMARK OFFICE

CERTIFICATE OF CORRECTION

PATENT NO. : 4,204,664

DATED : May 27, 1980

INVENTOR(S) : John F. Bryan, Jr.

It is certified that error appears in the above-identified patent and that said Letters Patent are hereby corrected as shown below:

Column 8, line 36, change "and" to --of--;
Column 8, line 45, change "drawn" to --draw--;
Column 10, line 3, change "292 (not shown) and 292'" to --292 and 292' (not shown)--;
Column 10, line 9, change second "156a" to --156b--;

Column 16, line 58, change "rearwad" to --rearward--;
Column 18, line 15, change "crame" to --crane--;
Column 21, line 11, change "said first" to -- to said first --.

Signed and Sealed this

*Eleventh* Day of *November 1980*

[SEAL]

*Attest:*

SIDNEY A. DIAMOND

*Attesting Officer*

*Commissioner of Patents and Trademarks*